US010453579B2

(12) United States Patent
Miyaoka

(10) Patent No.: US 10,453,579 B2
(45) Date of Patent: Oct. 22, 2019

(54) X-RAY GENERATOR

(71) Applicant: SHIMADZU CORPORATION, Kyoto (JP)

(72) Inventor: Akihiro Miyaoka, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 214 days.

(21) Appl. No.: 15/548,489

(22) PCT Filed: Feb. 5, 2015

(86) PCT No.: PCT/JP2015/053256

§ 371 (c)(1),
(2) Date: Aug. 3, 2017

(87) PCT Pub. No.: WO2016/125289

PCT Pub. Date: Aug. 11, 2016

(65) Prior Publication Data

US 2018/0005721 A1 Jan. 4, 2018

(51) Int. Cl.

| | |
|---|---|
| ***G21K 5/04*** | (2006.01) |
| ***H01J 35/18*** | (2006.01) |
| ***G21K 5/08*** | (2006.01) |
| ***H01J 35/08*** | (2006.01) |

(52) U.S. Cl.

CPC ..... *G21K 5/04* (2013.01); *G21K 5/08* (2013.01); *H01J 35/08* (2013.01); *H01J 35/18* (2013.01); *H01J 35/186* (2019.05); *H01J 2235/08* (2013.01); *H01J 2235/183* (2013.01)

(58) Field of Classification Search

CPC .. G01K 5/04; H01J 35/08; H01J 35/18; H01J 2235/08; H01J 2235/084; H01J 2235/087; H01J 2235/186; G21K 5/08

USPC ..... 378/138

See application file for complete search history.

(56) References Cited

FOREIGN PATENT DOCUMENTS

| | | | |
|---|---|---|---|
| JP | S37-18958 | B | 12/1962 |
| JP | H11-258400 | A | 9/1999 |
| JP | 2004-028845 | A | 1/2004 |
| JP | 2007-123022 | A | 5/2007 |
| JP | 2011-77027 | A | 4/2011 |

OTHER PUBLICATIONS

English translation of JP 2011-77027 A (Year: 2011).*

(Continued)

*Primary Examiner* — David P Porta
*Assistant Examiner* — Abra S Fein
(74) *Attorney, Agent, or Firm* — Maier & Maier, PLLC

(57) ABSTRACT

An X-ray generator capable of reliably reducing an X-ray focal spot size without depending on the focal spot size of an electron beam on a target. Providing, within the irradiation range of an electron beam B of a target laminated structure 3 comprising a target 2 and an X-ray irradiation window 1, a low X-ray absorptivity region 3*a* of localized low X-ray absorptivity in the irradiation direction of the electron beam B results in the suppression of emission to the outside of X-rays from among the X-rays generated as a result of the irradiation of the electron beam B onto the target 2 that are from regions other than the low X-ray absorptivity region 3*a*, and an X-ray focal spot of a size corresponding to the size of the low X-ray absorptivity region 3*a* is obtained regardless of the size of the irradiation region of the electron beam B.

12 Claims, 5 Drawing Sheets

(56) References Cited

OTHER PUBLICATIONS

International Search Report dated Apr. 21, 2015 in corresponding Application No. PCT/JP2015/053256; 1 pg.
Japanese Office Action dated Aug. 28, 2018, in connection with corresponding JP Application No. 2016-573013 (9 pgs., including English translation).

* cited by examiner

[FIG. 1]
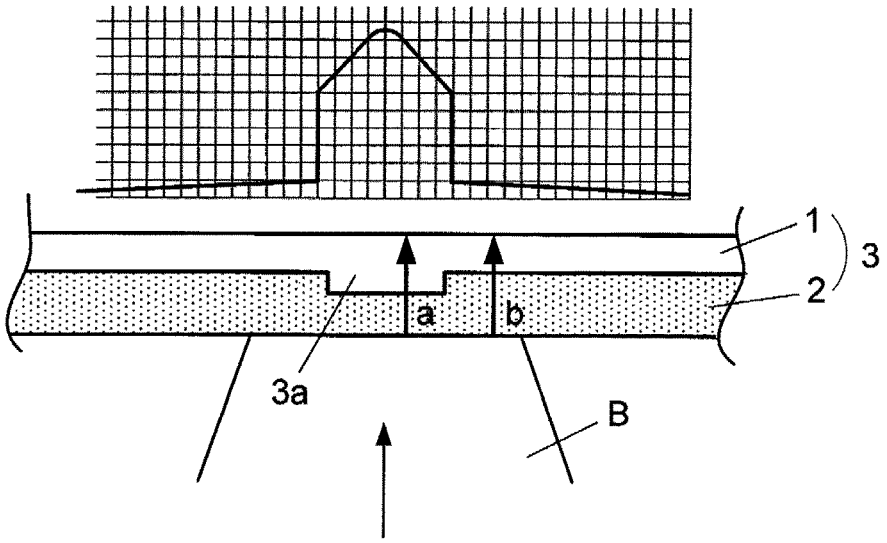
[FIG. 2]
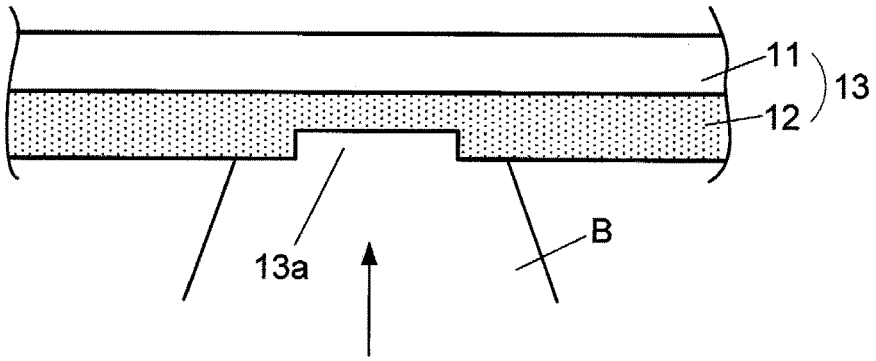
[FIG. 3]
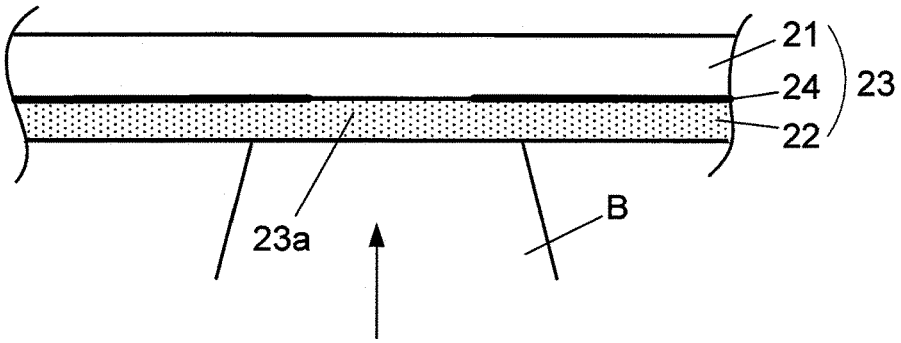

[FIG. 4]
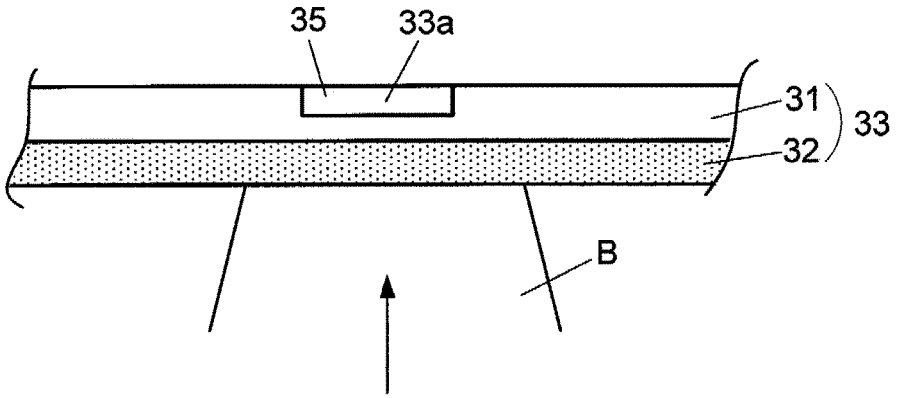
[FIG. 5]
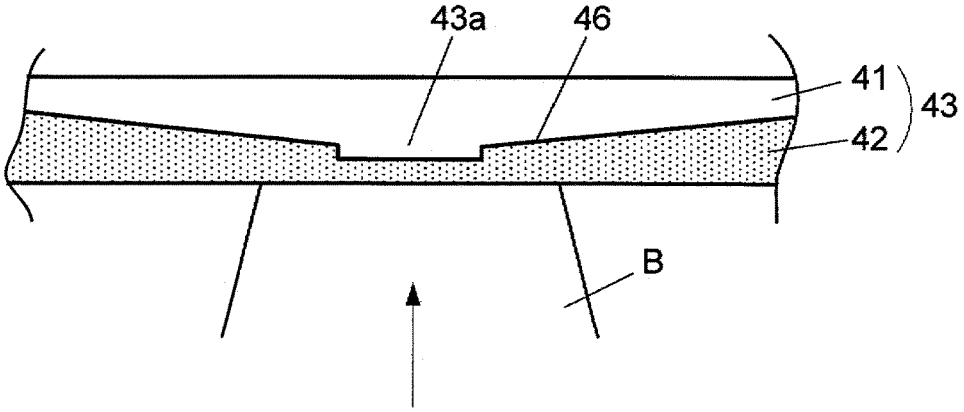
[FIG. 6]
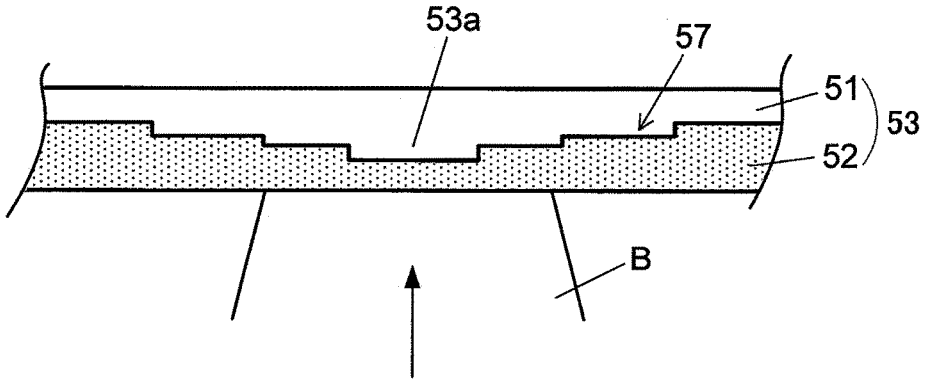

[FIG. 7]
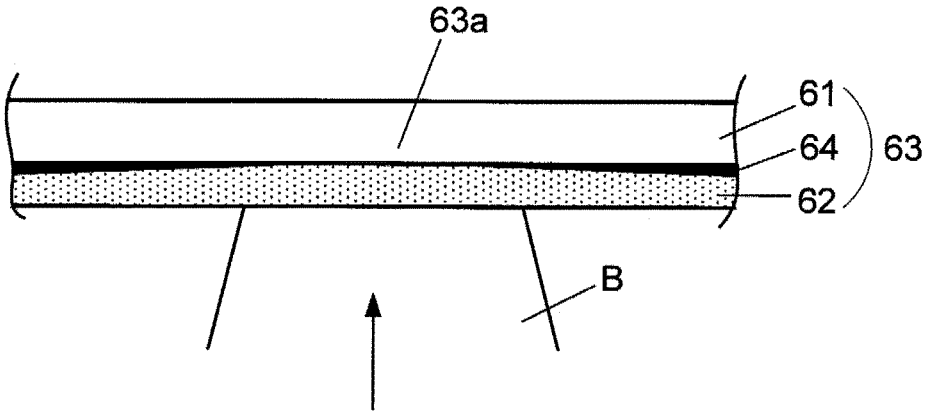

[FIG. 8]
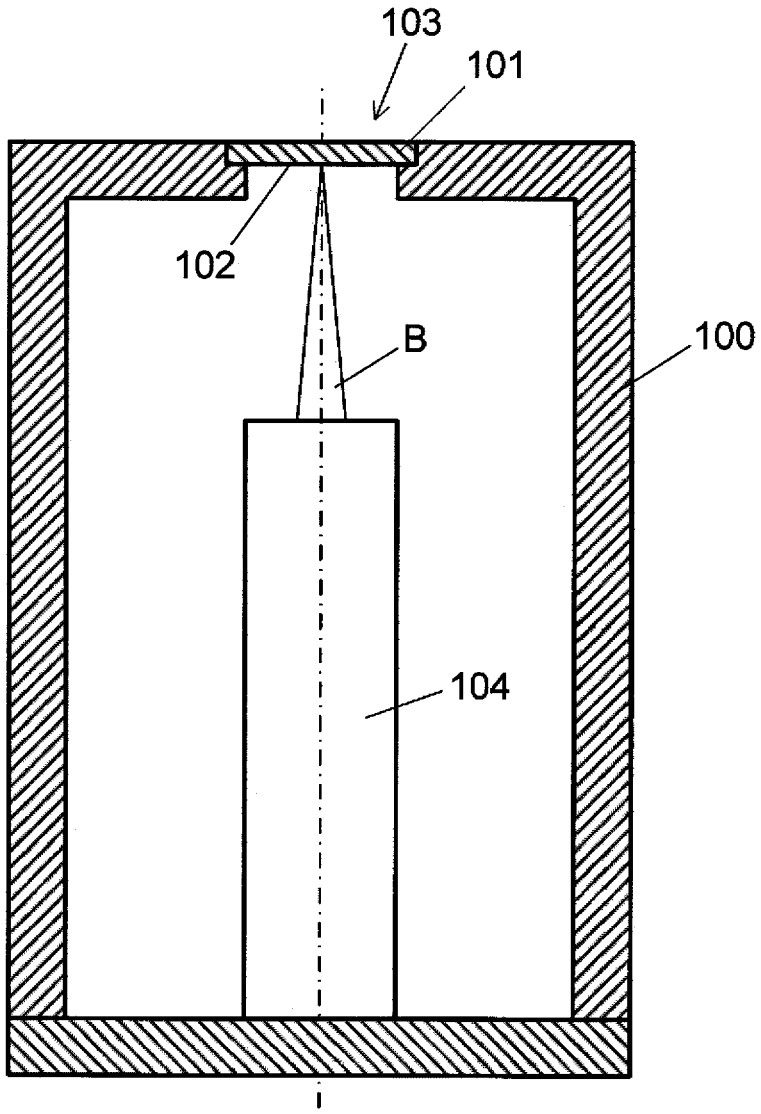

[FIG 9]
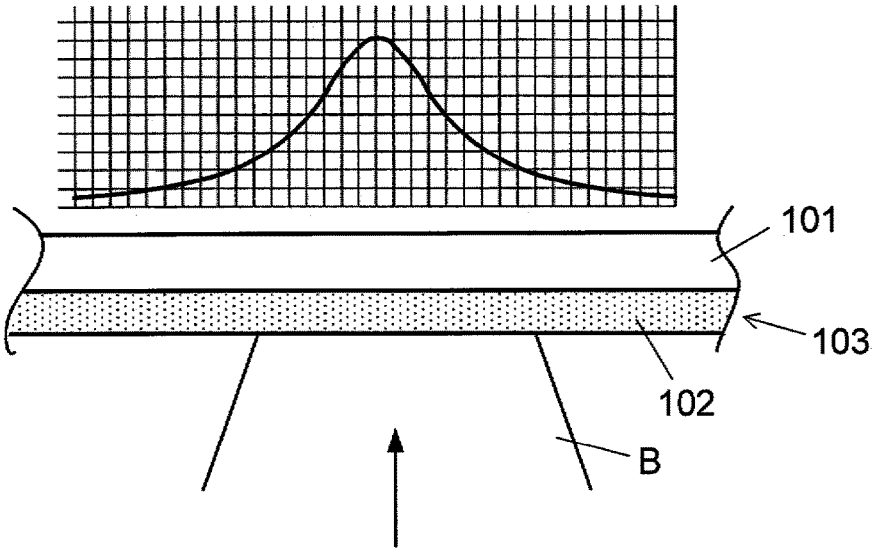
[FIG 10]
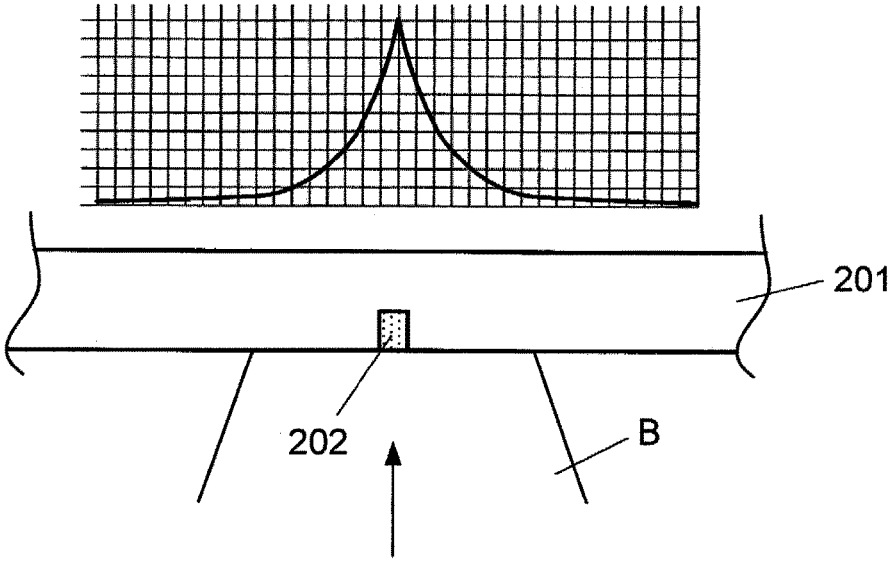

X-RAY GENERATOR

TECHNICAL FIELD

The present invention relates to an X-ray generator used for an industrial X-ray inspection apparatus, a medical X-ray inspection apparatus, or various X-ray analysis apparatuses or measurement apparatus using diffraction or refraction of an X-ray, and more specifically relates to a transmission type X-ray generator that extracts an X-ray generated by causing an electron to collide with a target in a vacuum container to the outside of the vacuum container around a direction along a traveling direction of the electron.

BACKGROUND ART

An X-ray generator of a type in which an X-ray is generated by irradiating a target with an electron beam in a vacuum container uses a reflective type target that extracts an X-ray in a different direction from a traveling direction of an electron or a transmission type target that extracts an X-ray in substantially the same direction as a traveling direction of an electron. In the X-ray generator using the reflective type target, an X-ray focal spot diameter (a diameter of a region in which an X-ray is generated) depends on a focal spot diameter of an electron beam emitted on the target (a spot diameter of the electron beam emitted on a target surface) and a surface angle of the target with respect to the electron beam. On the other hand, in the X-ray generator using the transmission type target, an X-ray focal spot diameter is determined based only on a focal spot diameter of an electron beam emitted on the target.

A configuration example of the X-ray generator using the transmission type target is illustrated as a schematic cross-sectional view in FIG. 8. An X-ray irradiation window 101 is fixed to one end portion of a vacuum container 100, and a target 102 for generation of X-rays is stacked on a lower surface side (an inner surface side of the container) of the X-ray irradiation window 101. The X-ray irradiation window 101 and the target 102 are integrated to form an inseparable member, and included in a target stacked structure 103. An electron gun 104 including an electron source and an electrode group is accommodated in the vacuum container 100. Further, an X-ray generated by irradiating the target 102 with an accelerated and focused electron beam from the electron gun 104 is extracted in substantially the same direction as an irradiation direction of the electron beam B through the X-ray irradiation window 101. The term "X-ray irradiation window" is used since the X-ray is emitted from the X-ray generator through the member. However, the term is also referred to as a target substrate or simply as a substrate considering a function as a member for holding the target. In this specification, only the X-ray irradiation window is used among these terms.

FIG. 9 illustrates an enlarged view of a portion around a region in which the target 102 is irradiated with the electron beam B in FIG. 8 and a graph indicating an X-ray profile emitted to the outside by this configuration. The X-ray profile is expressed by a graph in which a horizontal axis represents a position and a vertical axis represents X-ray intensity.

As illustrated in FIG. 9, a focal spot diameter of the electron beam B with respect to the target 102, that is, an irradiation spot diameter of the electron beam B emitted onto a surface of the target 102 corresponds to a focal spot diameter of the X-ray in the X-ray generator. When this X-ray focal spot diameter is reduced, for example, the spatial resolution of a fluoroscopic image obtained by an X-ray fluoroscopic apparatus is improved, and thus a clearer image is obtained.

In this regard, conventionally, in the X-ray generator using the transmission type target, a method of narrowing an electron beam and emitting the electron beam onto the target has been adopted to reduce the X-ray focal spot diameter. However, it is extremely difficult to narrow the electron beam that spreads from an electron source due to a problem of an aberration of a lens that narrows the electron beam. As a countermeasure, a method has been frequently adopted to reduce an influence of the aberration by providing a beam aperture. However, when the electron beam is formed as small as submicron order, there arises a new problem that the X-ray focal spot diameter increases due to diffusion of electrons in the target.

In this regard, in general, a technology has been proposed to reduce the X-ray focal spot without narrowing the focal spot diameter of the electron beam emitted toward the target by adopting a structure in which a target such as tungsten stacked on one surface of an X-ray irradiation window in the form of a thin film is buried in an X-ray irradiation window made of light metal as a fine columnar metal wire (for example, see Patent Document 1), or by forming a fine columnar hole portion in an X-ray irradiation window to deposit metal corresponding to a target material in the hole portion (for example, see Patent Document 2).

That is, as a schematic cross-sectional view and a graph of an X-ray profile emitted to the outside by a target structure are illustrated in FIG. 10, a technology has been proposed to reduce an X-ray focal spot diameter without narrowing the focal spot diameter of the electron beam B emitted toward a target 202 by restricting an X-ray generation region and reducing an influence of electron diffusion in the target 202 using a structure in which the target 202 having a fine columnar shape is held in an X-ray irradiation window 201.

CITATION LIST

Patent Document

Patent Document 1: JP-A-2004-28845
Patent Document 2: JP-A-2011-77027

DISCLOSURE OF THE INVENTION

Technical Problem

Incidentally, according to the above-described Patent Document 1 and Patent Document 2, intensity around a center of the X-ray profile increases, and the X-ray focal spot diameter with respect to the focal spot diameter of the emitted electron beam is improved. However, an X-ray is generated from an X-ray irradiation window using a light element member which rarely generates an X-ray due to irradiation of an electron beam, and electron diffusion reaches a wider region in the light element member. For this reason, in the end, there has been a problem that an X-ray focal spot diameter corresponding to an intended size may not be obtained unless an electron beam is narrowed to a certain size according to a size of a columnar target.

In addition, when compared to the conventional target illustrated in FIG. 9, in the proposed technology, a place to which the electron beam is applied needs to correspond to a place that includes a fine columnar target. Further, an irradiation position of the electron beam is restricted, and thus the irradiation position of the electron beam needs to be adjusted. For example, a size of the target needs to be set in micron order or submicron order to reduce the X-ray focal spot diameter. An electron beam irradiation range in which an X-ray is efficiently generated using such a fine target is extremely narrow, and there arises a problem that adjustment of an irradiation position until the target is found is difficult and extremely complicated.

The invention has been conceived in view of such circumstances, and an object of the invention is to provide an X-ray generator capable of reliably reducing an X-ray focal spot diameter without depending on a focal spot diameter of an electron beam with respect to a target.

In addition to the above description, another object of the invention is to simplify adjustment of an irradiation position of an electron beam on a target.

Solution to Problem

To solve the above-mentioned problem, an X-ray generator of the invention is an X-ray generator that extracts an X-ray generated by irradiating a target disposed in a vacuum container with an electron beam to an outside in a direction along an irradiation direction of the electron beam through an X-ray irradiation window on which the target is integrally stacked and formed, in which an X-ray low absorption rate part in which an X-ray absorption rate is locally low in the irradiation direction of the electron beam is formed in an irradiation region of the electron beam in a target stacked structure including the target and the X-ray irradiation window (claim 1).

Here, in the invention, it is desirable to adopt a configuration in which the X-ray absorption rate in the irradiation direction of the electron beam in the target stacked structure decreases continuously or stepwise toward the X-ray low absorption rate part at least in a predetermined region around the X-ray low absorption rate part (claim 2).

In addition, in the invention, it is desirable that a thickness of the target in the X-ray low absorption rate spot is larger than an electron diffusion distance in the target (claim 3).

In the invention, it is possible to adopt a configuration in which a difference in the X-ray absorption rate in the irradiation direction of the electron beam between positions in the target stacked structure results from a difference in the thickness of the target (claim 4).

In addition, in the invention, it is possible to adopt a configuration in which a difference in the X-ray absorption rate in the irradiation direction of the electron beam between positions in the target stacked structure results from a difference in a thickness of the X-ray irradiation window (claim 5).

Further, in the invention, it is possible to adopt a configuration in which a difference in the X-ray absorption rate in the irradiation direction of the electron beam between positions in the target stacked structure results from stacking an X-ray absorption layer for varying the X-ray absorption rate in the target stacked structure (claim 6).

The invention attempts to solve the problem by extracting only an X-ray from a local part in the irradiation region of the electron beam among X-rays generated in the irradiation region to the outside using a difference in the X-ray absorption rate of the target stacked structure formed by stacking the target on the X-ray irradiation window.

In more detail, when the X-ray low absorption rate part in which the X-ray absorption rate of the target stacked structure is locally low is provided in the irradiation region of the electron beam with respect to the target, and a difference with respect to another part is set to be large, X-rays from the X-ray low absorption rate part predominant in X-rays extracted to the outside through an X-ray absorption window. As a result, the X-ray low absorption rate part corresponds to a substantial X-ray focal spot. Therefore, an X-ray focal spot diameter may be reliably reduced irrespective of a focal spot diameter of the electron beam.

In addition, according to the above configurations of the invention, the X-ray low absorption rate part needs to be located in the irradiation region of the electron beam, and thus a position between the X-ray low absorption rate part and the irradiation region of the electron beam needs to be adjusted. However, the focal spot diameter of the electron beam may be increased by an extent obtained by eliminating a need to narrow the electron beam to prevent an electron beam corresponding to a part other than a part emitted onto the target from directly acting on the X-ray irradiation window to generate an X-ray as in a case of using a fine columnar target as in Patent Document 1 or 2. Thus, position adjustment becomes simpler.

Further, this position adjustment becomes easily by adopting the configuration of the invention according to claim 2. In more detail, the invention according to claim 2 adopts a configuration in which the X-ray absorption rate in the target stacked structure decreases toward the X-ray low absorption rate part in the predetermined region around the X-ray low absorption rate part. In this way, at the time of position adjustment of the X-ray low absorption rate part and the irradiation region of the electron beam, intensity of a generated X-ray may be monitored to change a relative position such that a stronger X-ray is generated.

In addition, by adopting the configuration of the invention according to claim 3 in which the target thickness in the X-ray low absorption rate part of the target stacked structure in the invention is larger than the electron diffusion distance in the target, an emitted electron does not reach the X-ray irradiation window in the X-ray low absorption rate part in addition to another part, and the X-ray focal spot diameter may be more reliably reduced without causing electron diffusion and X-ray generation in the X-ray irradiation window.

Advantageous Effects of the Invention

According to the invention, since an X-ray low absorption rate part in which an X-ray absorption rate is locally low is provided in an irradiation region of an electron beam in a target stacked structure obtained by integrally stacking a target and an X-ray irradiation window, and substantially only an X-ray from the X-ray low absorption rate part among X-rays generated by irradiation of the electron beam is extracted to the outside, an X-ray focal spot diameter depending on a size of the X-ray low absorption rate part is reliably obtained without narrowing the electron beam emitted onto the target.

In addition, positioning of the X-ray low absorption rate part and the electron beam irradiation region may be facilitated by adopting a configuration in which the X-ray absorption rate in the target stacked structure is decreased continuously or stepwise toward the X-ray low absorption rate part around the X-ray low absorption rate part.

BRIEF DESCRIPTION OF THE DRAWINGS

FIG. 1 is a schematic cross-sectional view of a portion around an electron beam irradiation region in a target stacked structure of an embodiment of the invention and a graph indicating an X-ray profile released to the outside by this configuration.

FIG. 2 is a schematic cross-sectional view of a portion around an electron beam irradiation region in a target stacked structure of another embodiment of the invention.

FIG. 3 is a schematic cross-sectional view of a portion around an electron beam irradiation region in a target stacked structure of still another embodiment of the invention.

FIG. 4 is a schematic cross-sectional view of a portion around an electron beam irradiation region in a target stacked structure of still another embodiment of the invention.

FIG. 5 is a schematic cross-sectional view of a portion around an electron beam irradiation region in a target stacked structure of an embodiment of the invention having a function of facilitating alignment of an irradiation position of the electron beam.

FIG. 6 is a schematic cross-sectional view of a portion around an electron beam irradiation region in a target stacked structure of another embodiment of the invention having a function of facilitating alignment of an irradiation position of the electron beam.

FIG. 7 is a schematic cross-sectional view of a portion around an electron beam irradiation region in a target stacked structure of still another embodiment of the invention having a function of facilitating alignment of an irradiation position of the electron beam.

FIG. 8 is a schematic cross-sectional view illustrating a configuration example of an X-ray generator using a transmission type target.

FIG. 9 is an enlarged view of a portion around a region in which a target is irradiated with an electron beam in FIG. 8 and a graph indicating an X-ray profile released to the outside by this configuration.

FIG. 10 is a schematic cross-sectional view of a portion around a region in which a target is irradiated with an electron beam in a conventional X-ray generator having a structure in which a fine columnar target is held in an X-ray irradiation window, and a graph indicating an X-ray profile released to the outside by this configuration.

MODE FOR CARRYING OUT THE INVENTION

Hereinafter, embodiments of the invention will be described with reference to drawings.

FIG. 1 is a schematic cross-sectional view of a main part of an embodiment of the invention and a graph indicating an X-ray profile emitted to the outside by this configuration. In this embodiment, a basic configuration as an X-ray generator is the same as that illustrated in FIG. 8, and a great feature is that a target stacked structure is changed from that illustrated in FIG. 9 to that illustrated in FIG. 1.

A target stacked structure 3 fixed to close one end portion of a vacuum container includes an X-ray irradiation window 1 and a target 2 stacked on an inner surface side of the container similarly to that of FIG. 9. Further, an electron beam B accelerated and focused from an electron gun in the vacuum container is emitted onto the target 2 to generate an X-ray. In general, W, Mo, Cu, etc. is used as a material of the target 2, and Al, Be, diamond, etc. is used for the X-ray irradiation window 1. In FIG. 1 to FIG. 10, an arrow in the electron beam B indicates an irradiation direction of the electron beam.

In the target stacked structure 3, an X-ray low absorption rate part 3*a* in which an X-ray absorption rate in an irradiation direction (X-ray extraction direction) of the electron beam B is locally low is formed in a region in which the target 2 is irradiated with the electron beam B. The X-ray low absorption rate part 3*a* in this example is formed by reducing a thickness of the target 2.

An element contained in the X-ray irradiation window 1 is a light element when compared to an element contained in the target 2. Further, when compared to an X-ray passing through an arrow a in the figure in the X-ray low absorption rate part 3*a*, an X-ray passing through an arrow b in another part is attenuated due to more absorption. As a result, the intensity of an X-ray profile emitted to the outside through the X-ray irradiation window 1 relatively increases around a center corresponding to a formation position of the X-ray low absorption rate part 3*a* as illustrated in FIG. 1. For this reason, the X-ray focal spot diameter becomes smaller when compared to a case of using the target having a uniform thickness illustrated in FIG. 9.

According to this configuration, an electron incident on the X-ray low absorption part 3*a* diffuses and an X-ray generated to reach the target 2 other than the part attenuates. Therefore, this configuration is particularly suitable to obtain an X-ray focal spot diameter less than or equal to 1 μm. In addition, due to the electron beam B incident on the X-ray low absorption rate part 3*a*, an X-ray obliquely emitted therefrom attenuates similarly to an X-ray passing through a part other than the X-ray low absorption rate part 3*a*, and thus this configuration is suitable for a case of reducing an X-ray irradiation angle.

In the above embodiment, the X-ray low absorption rate part 3*a* is formed by locally reducing the thickness of the target 2, more specifically, by providing a depression on a surface of the target 2 on a side at which the target 2 comes into contact with the X-ray irradiation window 1. However, the X-ray low absorption rate part may be formed by structures illustrated in FIG. 2 to FIG. 4 below.

In a target stacked structure 13 illustrated in FIG. 2, an X-ray low absorption rate part 13*a* is formed by providing a depression on a surface on an opposite side from a surface of a target 12 on a side at which the target 12 comes into contact with an X-ray irradiation window 11, and thus on a surface of the target 12 on an irradiation side of an electron beam B.

According to the structure illustrated in FIG. 2, an influence due to electron diffusion of the electron beam B incident on the X-ray low absorption rate part 13*a* to another part may not be reduced. However, the structure is suitable for a case of increasing an X-ray irradiation angle.

In a target stacked structure 23 illustrated in FIG. 3, an X-ray absorbing material 24 is stacked between an X-ray irradiation window 21 and a target 22, and a hole is provided in the X-ray absorbing material 24, thereby forming an X-ray low absorption rate part 23*a* in which an X-ray absorption rate is relatively low. A metal having a higher X-ray absorption rate than that of the target 22 is preferably used as a material of the X-ray absorbing material 24. For example, Pb may be used when W is used for the target 22, and W may be used when Cu is used for the target 22. According to the structure illustrated in FIG. 3, the same effect as that of the example illustrated in FIG. 1 may be obtained.

In a target stacked structure 33 illustrated in FIG. 4, a target 32 has a uniform thickness, and an X-ray transmitting member 35 made of a material having a lower X-ray absorption rate than that of a material of an X-ray irradiation window 31 is partially embedded in the X-ray irradiation window 31, thereby forming an X-ray low absorption rate part 33*a* in the target stacked structure 33. For example, Be may be used as the material of the X-ray transmitting member 35 when Al or diamond is used for the X-ray irradiation window 31. According to this configuration, the same effect as that of the example illustrated in FIG. 1 may be obtained.

It is possible to employ a configuration in which a depression is provided in the X-ray irradiation window 31, that is, a configuration in which air is used as the X-ray transmitting member 35 without using the X-ray transmitting member 35.

In each of the above embodiments, the X-ray low absorption rate part needs to be located inside an irradiation region of the electron beam B with respect to the target. However, in the invention, the X-ray focal spot diameter may be reduced without narrowing the electron beam. Therefore, when the irradiation region of the electron beam is set to be wide, positions thereof may not be particularly adjusted.

However, when X-ray intensity is increased, the density of the electron beam needs to be increased. When the density of the electron beam is increased while the irradiation region of the electron beam is widened, there arises another problem such as an increase in necessary power, an increase in the amount of heat generation of the target, etc. Therefore, it is useful to narrow the irradiation region by narrowing the electron beam to some extent. In this case, the irradiation position of the electron beam needs to be adjusted to the X-ray low absorption rate part. A configuration for facilitating position adjustment of the electron beam and the X-ray low absorption rate part will be described below.

In a target stacked structure 43 illustrated in FIG. 5, an X-ray low absorption rate part 43*a* is formed by forming a depression on a surface of a target 42 on an X-ray irradiation window 41 side similarly to the example of FIG. 1, and a portion around the X-ray low absorption rate part 43*a* on the surface of the target 42 on the same side is configured as a slope surface 46, so that an X-ray absorption rate gradually decreases toward the X-ray low absorption rate part 43*a*. In this way, when the irradiation position of the electron beam B is adjusted, it is sufficient to change the irradiation position of the electron beam B such that the X-ray intensity increases, and adjustment work is facilitated.

In a target stacked structure 53 illustrated in FIG. 6, a stepped surface 57 in which a thickness of a target decreases stepwise toward an X-ray low absorption rate part 53*a* is formed on a surface of the target 52 on an X-ray irradiation window 51 side around the X-ray low absorption rate part 53*a* formed in the same manner as that in the above description. The same effect as that in the above description may be obtained by this configuration.

As described above, the configuration in which the X-ray absorption rate decreases toward the X-ray low absorption rate part may be applied to the target stacked structure corresponding to the structures illustrated in FIG. 2 to FIG. 4. In the structure of FIG. 2, the same slope surface as that of the FIG. 5 or the stepped surface may be formed on the surface of the target 12 on the irradiation side of the electron beam B. In addition, in the structure of FIG. 4, an upper surface may be configured as a slope surface or a stepped surface such that the thickness of the X-ray irradiation window 31 increases toward an outer side. Further, in the structure of FIG. 3, as illustrated in FIG. 7, in a target stacked structure 63 in which an X-ray absorbing material 64 is stacked between an X-ray irradiation window 61 and a target 62, a thickness of the X-ray absorbing material 64 may be decreased toward an X-ray low absorption rate part 63*a*.

Here, in each of the above embodiments, a shape of an outline of the X-ray low absorption rate part viewed in the irradiation direction of the electron beam B is not particularly restricted, and may be set to an arbitrary shape such as a circle, a square, a polygon, etc. In addition, the slope surface and the stepped surface may be set to arbitrary shapes such as a cone and a circular stepped shape, a pyramid or a prismatic stepped shape, etc.

In addition, in each of the above embodiments, it is desirable to set the thickness of the target in the X-ray low absorption rate part to be larger than an electron diffusion distance. In this way, an electron incident on the X-ray low absorption rate part does not reach the X-ray irradiation window beyond the target. Therefore, it is possible to prevent a defect that an electron widely diffuses in the X-ray irradiation window and an X-ray is generated from a relatively wide region which is weak and unintended, thereby making the effect of the invention more reliable. The electron diffusion distance in the target differs depending on the material or acceleration energy of the electron beam, and thus an appropriate form or size may be employed according to a device specification.

INDUSTRIAL APPLICABILITY

The invention improves an X-ray focal spot using a target stacked structure including a target and an X-ray irradiation window of a transmission type X-ray generator. Unlike a technology of providing a collimator for shielding an X-ray in an unnecessary direction on the outside of an X-ray irradiation window, no structure is required on the outside of a vacuum container in the invention. Thus, it is possible to achieve the desired effect while a structure is simple and compact.

REFERENCE SIGNS LIST

1, 11, 21, 31, 41, 51, 61: X-ray irradiation window
2, 12, 22, 32, 42, 52, 62: target
3, 13, 23, 33, 43, 53, 63: target stacked structure
3*a*, 13*a*, 23*a*, 33*a*, 43*a*, 53*a*, 63*a*: X-ray low absorption rate part
24, 64: X-ray absorbing material
35: X-ray transmitting member
46: slope surface
57: stepped surface
100: vacuum container
101: X-ray irradiation window
102: target
103: target stacked structure
104: electron gun
B: electron beam

The invention claimed is:

1. An X-ray generator comprising:

the X-ray generator that extracts an X-ray generated by irradiating a target disposed in a vacuum container with an electron beam to an outside in a direction along an irradiation direction of the electron beam through an X-ray irradiation window on which the target is integrally stacked and formed, wherein an X-ray low absorption rate part in which an X-ray absorption rate is locally low in the irradiation direction of the electron beam is formed in an irradiation region of the electron beam in a target stacked structure including the target and the X-ray irradiation window, wherein a thickness of the target in the X-ray low absorption rate part is larger than an electron diffusion distance in the target.

2. The X-ray generator according to claim 1, wherein the X-ray absorption rate in the irradiation direction of the electron beam in the target stacked structure decreases continuously or stepwise toward the X-ray low absorption rate spot at least in a predetermined region around the X-ray low absorption rate spot.

3. The X-ray generator according to claim 2, wherein a thickness of the target in the X-ray low absorption rate part is larger than an electron diffusion distance in the target.

4. The X-ray generator according to claim 2, wherein a difference in the X-ray absorption rate in the irradiation direction of the electron beam between positions in the target stacked structure results from a difference in thickness of the target.

5. The X-ray generator according to claim 2, wherein a difference in the X-ray absorption rate in the irradiation direction of the electron beam between positions in the target stacked structure results from a difference in thickness of the X-ray irradiation window.

6. The X-ray generator according to claim 2, wherein a difference in the X-ray absorption rate in the irradiation direction of the electron beam between positions in the target stacked structure results from stacking an X-ray absorption layer for varying the X-ray absorption rate in the target stacked structure.

7. The X-ray generator according to claim 1, wherein a difference in the X-ray absorption rate in the irradiation direction of the electron beam between positions in the target stacked structure results from a difference in thickness of the target.

8. The X-ray generator according to claim 1, wherein a difference in the X-ray absorption rate in the irradiation direction of the electron beam between positions in the target stacked structure results from a difference in thickness of the X-ray irradiation window.

9. The X-ray generator according to claim 1, wherein a difference in the X-ray absorption rate in the irradiation direction of the electron beam between positions in the target stacked structure results from stacking an X-ray absorption layer for varying the X-ray absorption rate in the target stacked structure.

10. The X-ray generator according to claim 1, wherein a difference in the X-ray absorption rate in the irradiation direction of the electron beam between positions in the target stacked structure results from a difference in thickness of the target.

11. The X-ray generator according to claim 1, wherein a difference in the X-ray absorption rate in the irradiation direction of the electron beam between positions in the target stacked structure results from a difference in thickness of the X-ray irradiation window.

12. The X-ray generator according to claim 1, wherein a difference in the X-ray absorption rate in the irradiation direction of the electron beam between positions in the target stacked structure results from stacking an X-ray absorption layer for varying the X-ray absorption rate in the target stacked structure.

* * * * *